US010881933B2

(12) United States Patent
Xiong

(10) Patent No.: US 10,881,933 B2
(45) Date of Patent: Jan. 5, 2021

(54) BALL GAME HAVING AN ILLUMINATION DEVICE

(71) Applicant: Wanghui Xiong, Guangdong (CN)

(72) Inventor: Wanghui Xiong, Guangdong (CN)

(73) Assignee: Shenzhen Blinngo Limited Company, Shenzhen (CN)

( * ) Notice: Subject to any disclaimer, the term of this patent is extended or adjusted under 35 U.S.C. 154(b) by 0 days.

(21) Appl. No.: 16/675,224

(22) Filed: Nov. 6, 2019

(65) Prior Publication Data

US 2020/0070024 A1 Mar. 5, 2020

(51) Int. Cl.

| | |
|---|---|
| ***A63B 67/00*** | (2006.01) |
| ***A63B 63/00*** | (2006.01) |
| ***A63B 5/11*** | (2006.01) |

(52) U.S. Cl.

CPC ..... *A63B 67/002* (2013.01); *A63B 5/11* (2013.01); *A63B 63/007* (2013.01); *A63B 2067/005* (2013.01); *A63B 2225/74* (2020.08)

(58) Field of Classification Search

CPC ..... A63B 67/002; A63B 5/11; A63B 63/007; A63B 2067/005; A63B 2207/02; A63B 71/00; A63B 2225/74; A63H 33/26

USPC ..... 273/342; 482/27

See application file for complete search history.

(56) References Cited

U.S. PATENT DOCUMENTS

| | | | | | |
|---|---|---|---|---|---|
| 4,006,556 | A * | 2/1977 | Williams | A63B 19/00 | 446/242 |
| 4,085,541 | A * | 4/1978 | Mapp | A63H 33/02 | 362/184 |
| 5,108,340 | A * | 4/1992 | Farrow | A63B 19/00 | 446/242 |
| 5,403,000 | A * | 4/1995 | Woosley | A63B 43/06 | 473/447 |
| 5,772,537 | A * | 6/1998 | Anderson | A63B 69/0097 | 273/396 |
| 8,807,568 | B1 * | 8/2014 | Ruder | A63B 67/002 | 273/342 |
| 2006/0135321 | A1 * | 6/2006 | Chen | A63B 5/00 | 482/27 |
| 2011/0074112 | A1 * | 3/2011 | Allen | F41J 1/10 | 273/407 |
| 2012/0077642 | A1 * | 3/2012 | Chen | A63B 5/11 | 482/27 |
| 2014/0051550 | A1 * | 2/2014 | Chen | A63B 5/11 | 482/27 |
| 2014/0287879 | A1 * | 9/2014 | Hall | G09B 19/00 | 482/27 |
| 2017/0239543 | A1 * | 8/2017 | Seto | A63B 71/0622 | |
| 2018/0154233 | A1 * | 6/2018 | Mueller | F21V 33/008 | |
| 2018/0214728 | A1 * | 8/2018 | Ben Meir | A63B 5/11 | |
| 2019/0072246 | A1 * | 3/2019 | Plavnicky | F21V 3/062 | |
| 2019/0269993 | A1 * | 9/2019 | Gonzales | A63B 61/00 | |

* cited by examiner

*Primary Examiner* — Michael D Dennis

(57) ABSTRACT

A ball game includes a base frame; a bed disposed on the base frame; a plurality of legs attached to the base frame and extending downward to place on a support surface; a ring lamp secured to the base frame; and a plurality of holes each through one of the legs.

6 Claims, 5 Drawing Sheets

BALL GAME HAVING AN ILLUMINATION DEVICE

BACKGROUND OF THE INVENTION

1. Field of the Invention

The invention relates to ball games and more particularly to a ball game having an illumination device with improved characteristics.

2. Description of Related Art

Materials used in roundnet include a small trampoline-like object with string netting, a small bouncing ball and four players. In standard play, players line up next to each other around the trampoline. The game starts with a serve from one team to another, continues as long as the ball is being hit from players back to the net, and ends when an infraction occurs between either the players or the ball.

Conventional roundnets are disadvantageous because they have the following drawbacks: The base frame may be blurry in a dark environment and in turn it may adversely affect the jumping activities. Bouncing force of a ball is only provided by elasticity of the net mounted on the base frame. Also, elasticity of fibers of the net is very weak. Thus, bouncing force of the ball is not strong. It is found that the ball may bounce a very short height above the net if a player uses a small force to throw the ball onto the net and it can greatly decrease. To the contrary, the base frame may not withstand a strong force of the ball thrown onto the net by the player. The strong force may transfer to the base frame. As such, the base frame may move or displace. And in turn, it may compromise the recreational purpose. Finally, the roundnet may be unstable or move if it is placed on a non-rigid support surface (e.g., beach or grassland).

Thus, the need for improvement still exists.

SUMMARY OF THE INVENTION

It is therefore one object of the invention to provide a ball game comprising a base frame; a bed disposed on the base frame; a plurality of legs attached to the base frame and extending downward to place on a support surface; a ring lamp secured to the base frame; and a plurality of holes each through one of the legs.

The above and other objects, features and advantages of the invention will become apparent from the following detailed description taken with the accompanying drawings.

DETAILED DESCRIPTION OF THE INVENTION

Figure 1:
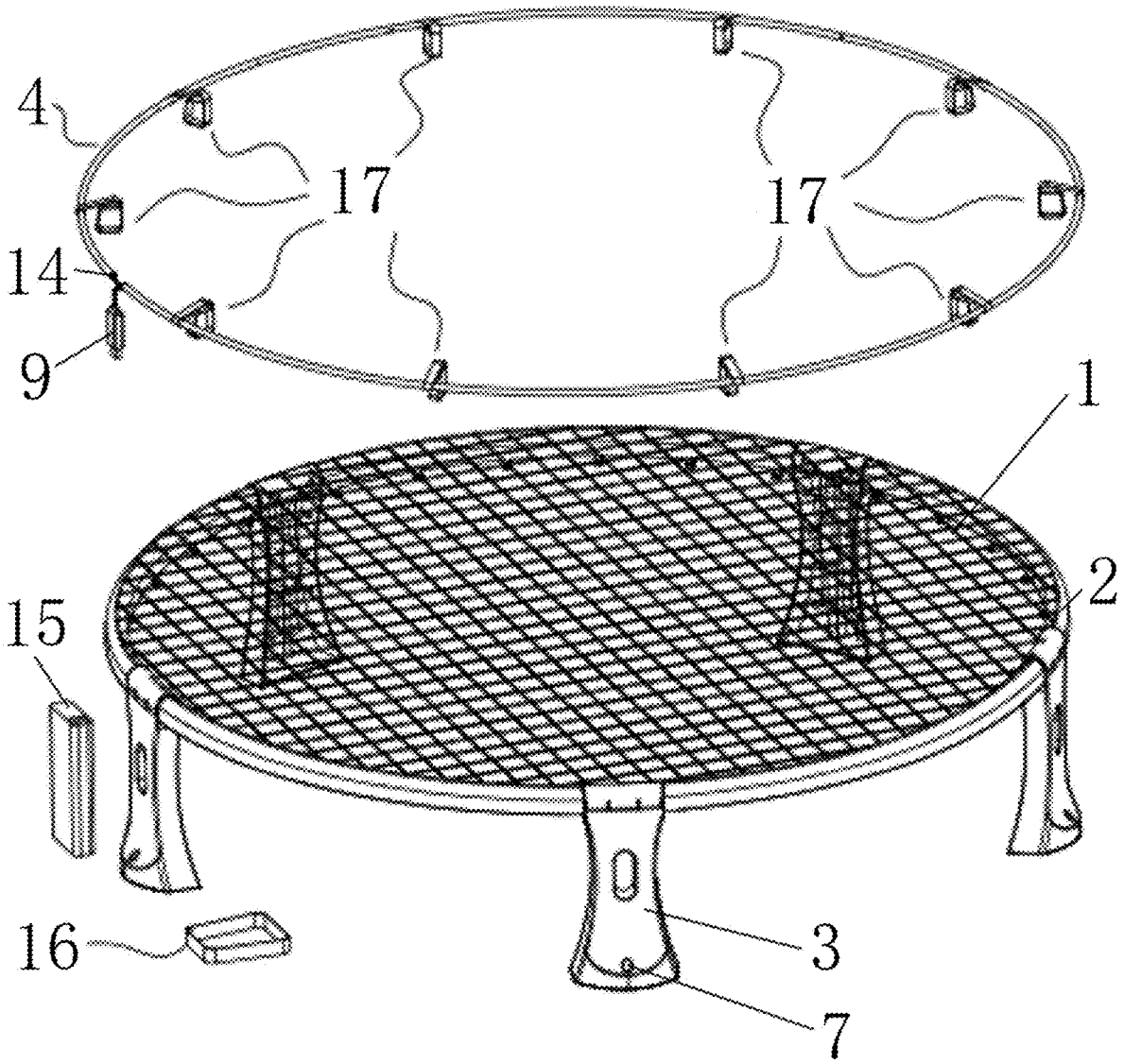
FIG. 1 is an explode view of a ball game according to the invention.
Figure 2:
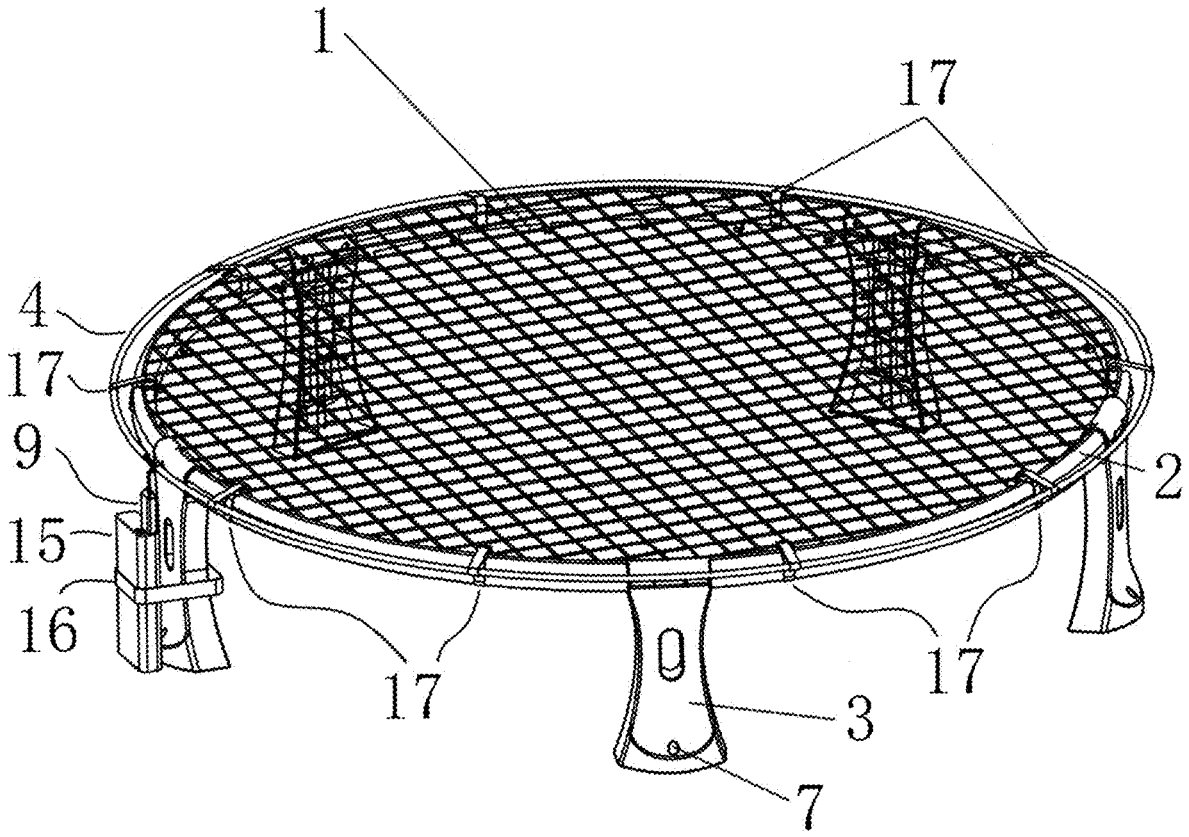
FIG. 2 is a perspective view of the assembled ball game.
Figure 3A:
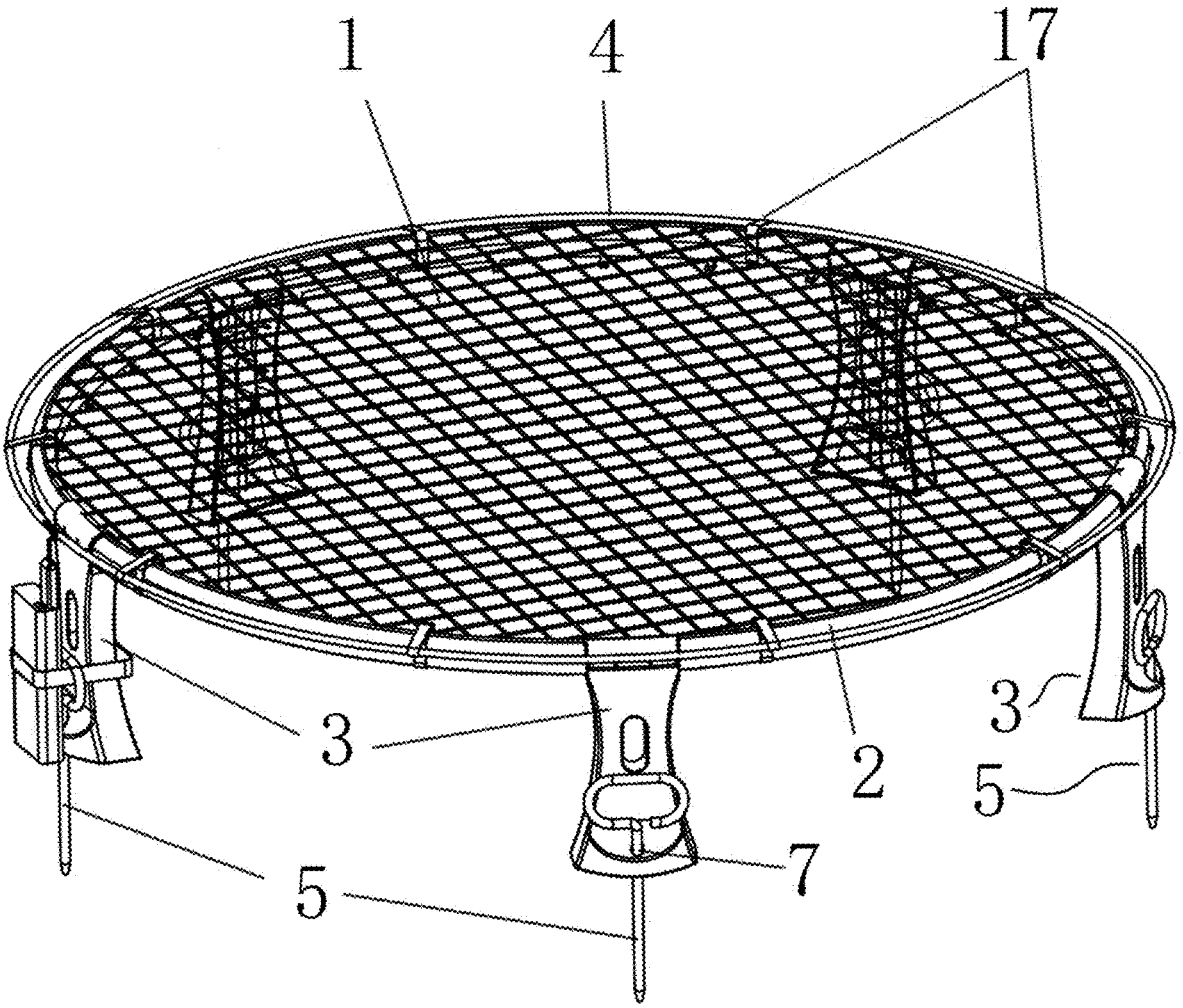
FIG. 3A is a perspective view of the ball game showing the legs and the nails.
Figure 3B:
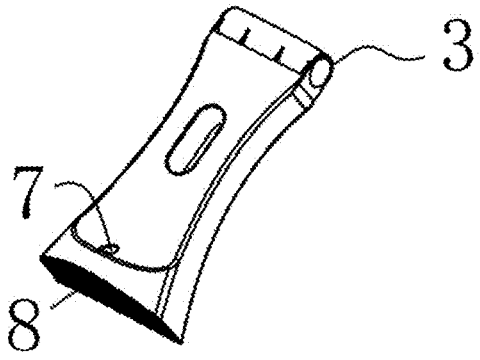
FIG. 3B is a perspective view of the leg.
Figure 4A:
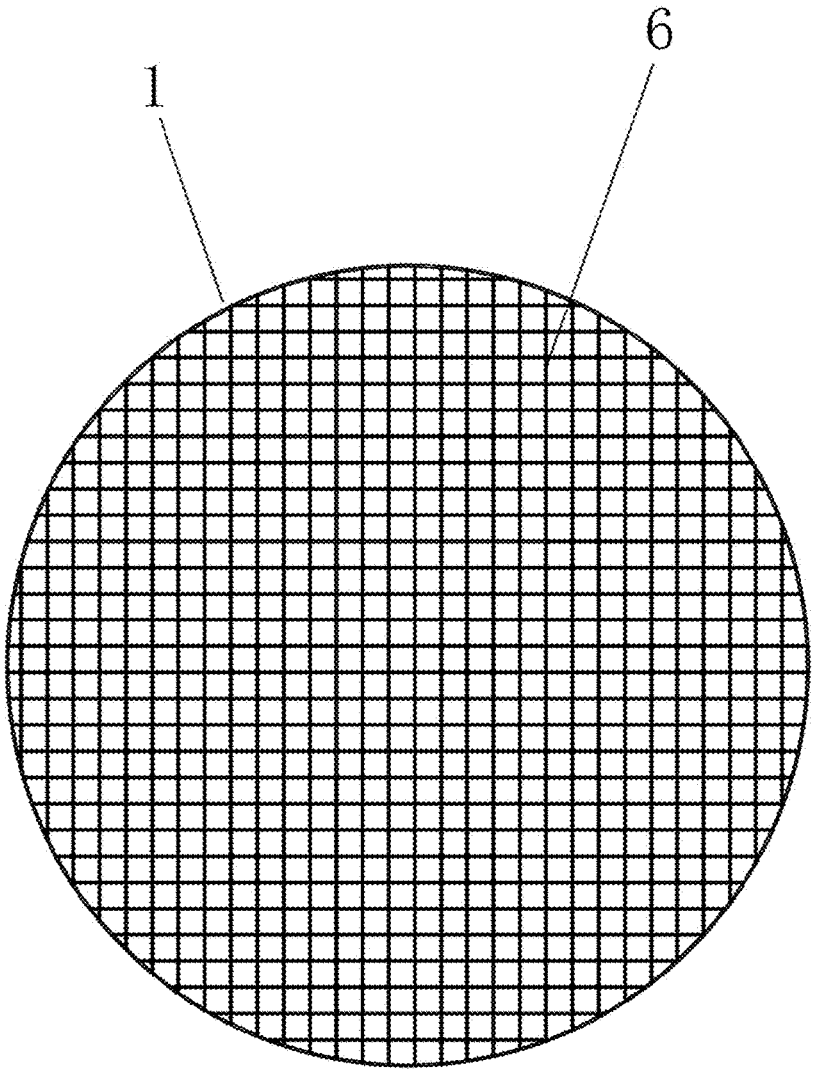
FIG. 4A is a plan view of the bed.
Figure 4B:
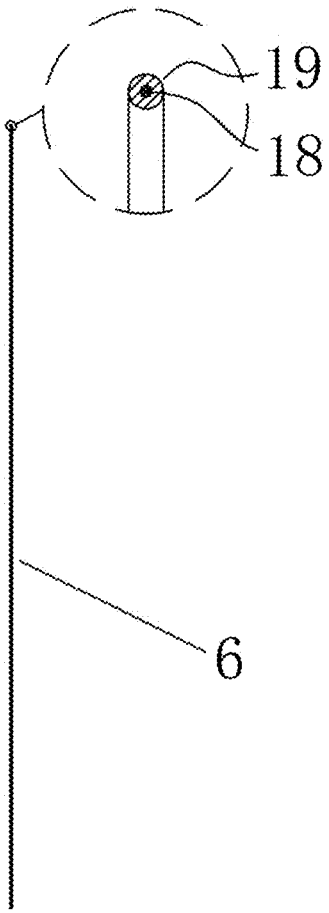
FIG. 4B is a plan view of the wire.
Figure 5:
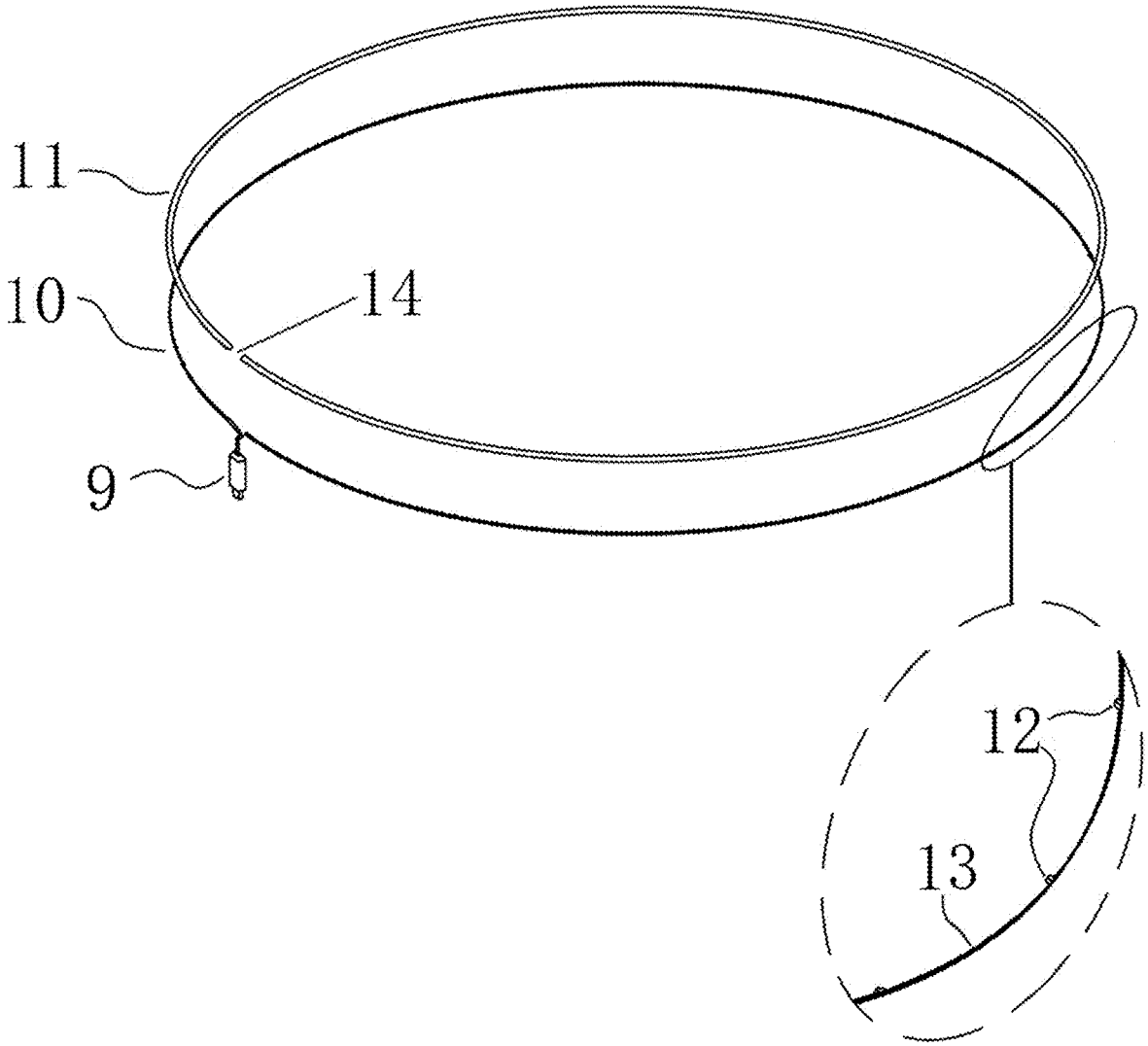
FIG. 5 is a perspective view of the ring lamp.

Referring to FIGS. 1 to 5, a ball game in accordance with the invention comprises the a base frame 2, a bed 1 mounted on the base frame 2, a plurality of legs 3 attached to the base frame 2 and extending downward, a ring lamp 4 mounted around the base frame 2, and a plurality of holes 7 each through an enlarged lower portion of the leg 3. The ball game can be secured onto a support surface (e.g., beach or grassland) as detailed later.

The bed 1 includes a plurality of meshed wires 6. The wire 6 includes a rubber band 18 and a fiber 19 disposed on the rubber band 18 by weaving. Thus, the bed 1 is resilient due to the rubber bands 18 and the fibers 19. The base frame 2 is a hollow ring.

The ball game further comprises a plurality of nails 5 each driven through the hole 7 to secure the leg 3 to the support surface; and a plurality of slip resistant members 8 each mounted on a bottom of the leg 3.

The ring lamp 4 includes a USB (Universal Serial Bus) plug 9, an illumination member 10 connected to the USB plug 9, and a ring-shaped cover 11 being mated with the base frame 2 and configured to receive and cover the illumination member 10. The illumination member 10 includes a plurality of copper wires 13 and a plurality of light emitting elements 12 mounted on the copper wires 13 by soldering. The USB plug 9 is connected to two ends of the copper wires 13. The cover 11 is broken at an opening 14 and the USB plug 9 is mounted to an end of the cover 11 adjacent to the opening 14. The cover 11 is made of transparent or translucent PVC (polyvinyl chloride).

The ball game further comprises a power supply 15 and a first fastening member 16 for securing the power supply 15 to one of the legs 3 proximate the USB plug 9 so that the USB plug 9 may be electrically connected to the power supply 15 to supply electricity to the ring lamp 4. Preferably, the power supply 15 is a rechargeable battery or the like, and the first fastening member 16 is a strap, a clamp or the like.

The ball game further comprises a plurality of second fastening members 17 for securing the ring lamp 4 to the base frame 2. The second fastening member 17 is a hook-and-loop fastener, strap, clamp or the like. The wire 6 is further provided with a plurality of LEDs (light-emitting diodes) and an internal conductor electrically connected to the LEDs. The conductor extends out of two ends of the wire 6 to fasten in the base frame 2. An outlet is provided on the base frame 2 electrically connected to the conductor. The wire 6 is further provided with a plurality of reflective stripes adhered thereto.

The ball game further comprises a strip light. The base frame 2 is a transparent, hollow ring with the strip light disposed therein. The base frame 2 is further provided with an outlet for electrically connecting to the strip light. The base frame 2 is further provided a plurality of apertures for allowing light to pass through.

Another strip light is provided in the base frame 2 and electrically connected to an outlet of the base frame 2. The base frame 2 is made of transparent material so that light emitted by the ring lamp 4 can pass through the base frame 2 for illumination purposes. In brief, the base frame 2 and the ring lamp 4 are unitary.

It is envisaged by the invention that the ring lamp 4 can illuminate the base frame 2 in use. Further, other light emitting members of the base frame 2 are capable of emitting light to illuminating the base frame 2 in use. In the embodiment, the LEDs or the reflective stripes are capable of illuminating the bed 1 in use. Further, the base frame 2 and the legs 3 are made of transparent material so that the ball game can be illuminated when the light emitting components of the ball game are energized.

The invention has the following characteristics and advantages: the ring lamp is provided in the ring lamp. The LEDs or the reflective stripes are provided on the bed so that the ball game can be illuminated in a dark environment. The rubber bands and the fibers of the wires provide a sufficient resilience and tautness to the bed. The nails and the slip resistant members increase stability and immovability the ball game on the support surface. The wires of the bed do not permanently deform and remain elastically, elastically strong irrespective of force exerted by players playing the game after a long period of time of use. The base frame is not subject to movement or displacement during the playing time. Its playing is full of fun.

While the invention has been described in terms of preferred embodiments, those skilled in the art will recognize that the invention can be practiced with modifications within the spirit and scope of the appended claims.

What is claimed is:

1. A ball game, comprising:

a base frame;

a bed disposed on the base frame;

a plurality of legs attached to the base frame and extending downward;

a plurality of holes each through one of the legs; and a ring lamp secured to the base frame and including a USB plug, an illumination member connected to the USB plug, and a ring-shaped cover being mated with the base frame and configured to receive and cover the illumination member;

wherein the illumination member includes a plurality of copper wires and a plurality of light emitting elements mounted on the copper wires;

wherein the USB plug is connected to two ends of the copper wires; and wherein the cover is broken at an opening and the USB plug is mounted to an end of the cover adjacent to the opening.

2. The ball game of claim 1, further comprising a power supply and a fastening member for securing the power supply to one of the legs proximate the USB plug so that the USB plug is configured to electrically connect to the power supply.

3. The ball game of claim 1, further comprising a plurality of fastening elements for securing the ring lamp to the base frame.

4. The ball game of claim 1, wherein the bed comprise a plurality of LEDs and an internal conductor electrically connected to the LEDs and secured to the base frame; further comprising an outlet disposed on the base frame for electrically connecting to the internal conductor.

5. The ball game of claim 1, further comprising a plurality of reflective stripes adhered to the bed.

6. The ball game of claim 1, further comprising a strip light; wherein the base frame is a transparent, hollow ring with the strip light disposed therein.

* * * * *